United States Patent [19]

Coppin et al.

[11] Patent Number: 4,573,907

[45] Date of Patent: Mar. 4, 1986

[54] LOW OXYGEN AND LOW PRESSURE DROP BURNER

[75] Inventors: William P. Coppin; Tadeusz Karabin, both of Muncie, Ind.

[73] Assignee: Maxon Corporation, Muncie, Ind.

[21] Appl. No.: 669,019

[22] Filed: Nov. 7, 1984

[51] Int. Cl.[4] ..... F23D 15/00

[52] U.S. Cl. ..... 431/351; 432/222; 431/350

[58] Field of Search ..... 431/350, 351, 352, 356; 432/222

[56] References Cited

U.S. PATENT DOCUMENTS

| | | | |
|---|---|---|---|
| 3,051,464 | 8/1962 | Yeo et al. | 431/351 |
| 3,187,523 | 6/1965 | Kilbourn | 431/351 |
| 3,265,376 | 8/1966 | Spielman | 432/222 |
| 3,587,232 | 6/1971 | Bryce | 431/350 |
| 3,592,578 | 7/1971 | Weatherston | 431/351 |
| 3,630,649 | 12/1971 | Hancock | 431/350 |
| 3,649,211 | 3/1972 | Vosper | 431/350 |
| 3,843,309 | 10/1974 | Lambiris | 432/222 |
| 4,004,056 | 1/1977 | Carroll | 431/352 |
| 4,493,638 | 1/1985 | Scammell | 431/350 |
| 4,523,905 | 6/1985 | Lewis | 431/350 |

FOREIGN PATENT DOCUMENTS

| | | | |
|---|---|---|---|
| 8006199 | 2/1981 | Netherlands | 431/350 |
| 2117506 | 10/1983 | United Kingdom | 431/352 |

*Primary Examiner*—James C. Yeung
*Assistant Examiner*—H. A. Odar
*Attorney, Agent, or Firm*—Robert M. Ward

[57] ABSTRACT

The improved burner unit of the present invention is designed for use in relatively lower oxygen and/or lower pressure drop environments. The improved burner unit of the present invention comprises a burner base disposed at the bottom of the burner trough. A pair of mixing plates having aeration openings therein are attached on opposite sides of the burner base. The mixing plates include a lower flange for attachment to the burner base and a mixing plate body extending upwardly from such lower flange. The mixing plate body forms the sides of the burner trough and includes an outwardly protruding bulge at the center of the mixing plate. The burner unit also includes side flanges disposed on and extending from the sides of the mixing plate for engagement with like side flanges on like mixing plates to form a burner of the desired length. In preferred embodiments, the bulge in the side of the mixing plate body is generally parabolic in shape as viewed from the trough of the burner.

19 Claims, 3 Drawing Figures

LOW OXYGEN AND LOW PRESSURE DROP BURNER

BACKGROUND OF THE DISCLOSURE

The present invention is directed in general to burners for gaseous fuels, and more particularly to a mixing plate which includes an outwardly protruding bulge at the center thereof.

Prior art burners for gaseous fuel are set forth, for example in British Pat. No. 1,044,235 to Eclipse Fuel Engineering, and in U.S. Pat. No. 4,340,180 to Belknap and Coppin, and the references cited therein.

Such prior art burners have been in general designed primarily for operation in ambient air streams, or relatively high oxygen, heated air streams. Such high oxygen air streams have in general contained at least 18% oxygen. However, in many present applications, the use of such previous burners is somewhat limited. In many instances, such burners have had to have been derated, and primary air utilized, or velocities have had to have been increased substantially. The net result of these modifications has greatly decreased system design flexibility for any particular use.

Also, prior art burner designs have required relatively large amounts of space. In some instances, as much as 0.70 sq. ft. per lineal foot of displacement have been required.

Yet further, prior art burners have not included adequate means for controlling or relieving pressure caused by thermal expansion during heating. As a result, the hinge points of the burner plates have undergone considerble stress, which greatly reduces plate life, and especially in certain harsh environments.

In view of the above difficulties, disadvantages and infirmities of prior art burner plates, it is an object of the improved burner unit of the present invention to materially alleviate such difficulties.

It is also an object of the improved burner unit of the present invention to provide an improved burner unit which may be utilized in relatively low oxygen air streams, and to provide flame retention, at rated capacity, over a much broader range of air stream conditions.

It is a concomitant object of the improved burner unit of the present invention to provide a burner unit which will function satisfactorily down to 800 feet per minute in ambient air, and in an air stream as low as 12% oxygen in a hot, oxygen deficient air stream at reasonable velocities without the need for primary air.

It is a further object of the improved burner unit of the present invention to reduce the displacement to as low as approximately 0.38 sq. ft. per lineal foot, and thus to provide a broader range of flexibility to the engineer in systems design and wherein such engineer may design the system without exceeding the allowable flame lengths or allowable pressure drops for such application.

It is a yet further object of the improved burner unit of the present invention to provide mixing plates of an unique shape, thereby to eliminate stress points caused by thermal expansion and contraction.

These and other objects of the improved burner unit of the present invention will be better understood by those having ordinary skill in the art, in view of the Summary of the Invention, Brief Description of the Drawing, Detailed Description of Preferred Embodiments, the attached Drawing, and the appended Claims.

BRIEF DESCRIPTION OF THE DRAWING

The improved burner unit of the present invention is set forth in the accompanying Drawing, and in which.

DETAILED DESCRIPTION OF PREFERRED EMBODIMENTS

Figure 1:
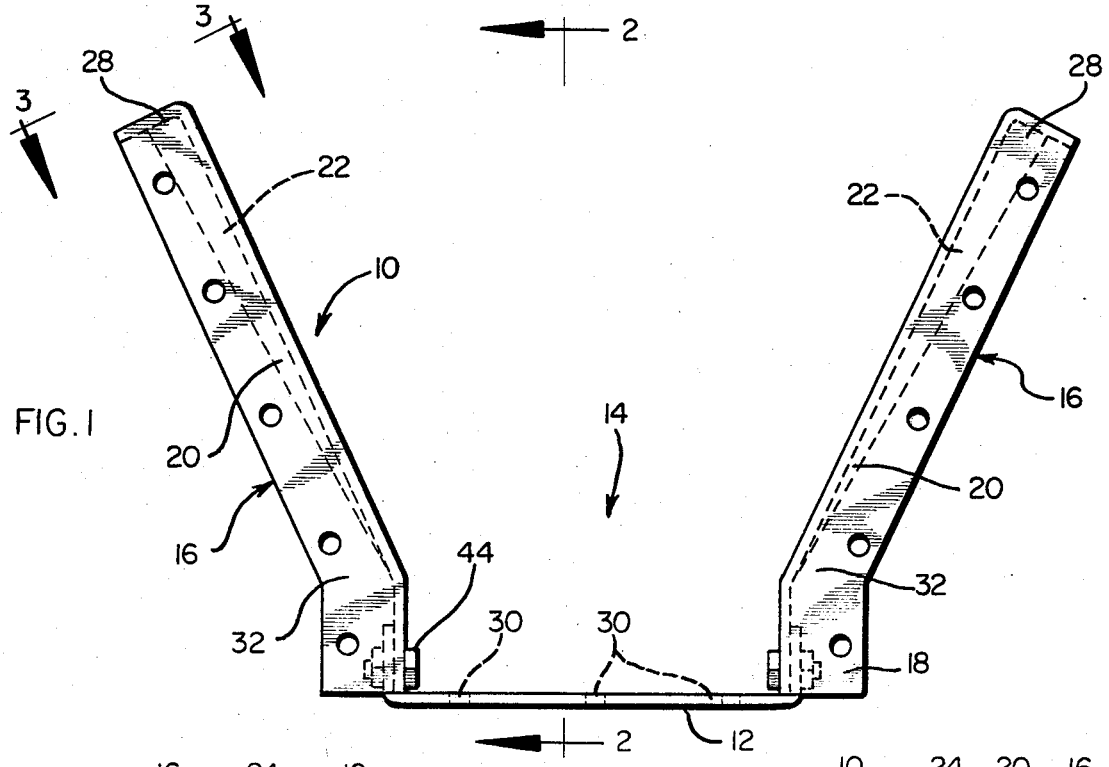
FIG. 1 is a longitudinal view, showing the side flanges of the mixing plate body of the improved burner unit of the present invention disposed on either side and attached to a centrally disposed burner base at the bottom thereof.

The improved burner unit of the present invention is for disposition in longitudinally connected array to form a burner trough. The improved burner unit of the present invention may be especially useful in relatively lower oxygen and/or lower pressure drop air streams. The structure of the present invention includes improved thermal expansion performance.

The burner unit of the present invention includes a burner base which is disposed at the bottom of the burner trough. A pair of mixing plates having aeration openings therein are disposed on opposite lateral sides of the burner base. The mixing plates include a lower flange disposed at the bottom of the mixing plate for attachment of the mixing plate to the burner plate.

The mixing plate body extends upwardly from the lower flange to form the sides of the burner trough. The mixing plate body has an outwardly protruding bulge at the center thereof. Side flanges are disposed on and extend from the sides of the mixing plate for engagement with and securement in series to a corresponding side flange of a further mixing plate to form the longitudinally arrayed burner. In preferred embodiments, the bulge in the mixing plate body is generally parabolic in shape as viewed from the trough of the burner, although other similar smooth curves may be utilized. Such smooth curve, such as a parabola, preferably extends in preferred embodiments from a point proximate to the lower flange, with the smooth curve or parabola opening upwardly towards the top of the mixing plate. The burner base includes a plurality of apertures therein for an emission of burner fuel into the burner trough.

In preferred embodiments, the bulge in the mixing plate wall is disposed in the center of the mixing plate body. In such preferred embodiments, such bulge is greater in outward extension near the top of the outward bulge, and lesser in outward extension near the bottom thereof. The preferred shape for such outward bulge in horizontal section is a partial arc of a circle.

Also in preferred embodiments, the aeration openings of the mixing plate increase in area from the bottom to the top of said mixing plate. Such aeration openings may preferably also increase in number from the bottom to the top of the mixing plate. Hence, in these and other such preferred embodiments, the total area of the mixing plate apertures increases from the bottom of the mixing plate to the top thereof.

Such aeration openings are preferably disposed in horizontally extending rows, and may comprise circles and/or slots. Where such mixing plate aeration openings comprise slots, the slots may be preferably greater in the vertical dimension than in the horizontal dimension. A plurality of mixing plate apertures of relatively small area may be preferably disposed near the top portion of the lower flange to provide aeration at minimum firing rates.

The lower flange and the mixing body plate are disposed with respect to each other at an angle which is less than approximately 180° and more than approximately 135°, with an optimum angle of disposition at approximately 155°.

With reference now to the Drawing and to FIG. 1 in particular, the burner unit of the present invention generally 10 includes a burner base 12 which is disposed at the bottom of the burner trough generally 14. A pair of mixing plates generally 16, 16 are disposed on opposite lateral sides of burner base 12. Mixing plates 16, 16 include a lower flange 18 disposed at the bottom of mixing plates 16 for attachment of mixing plate 16 to burner base 12.

Figure 2:
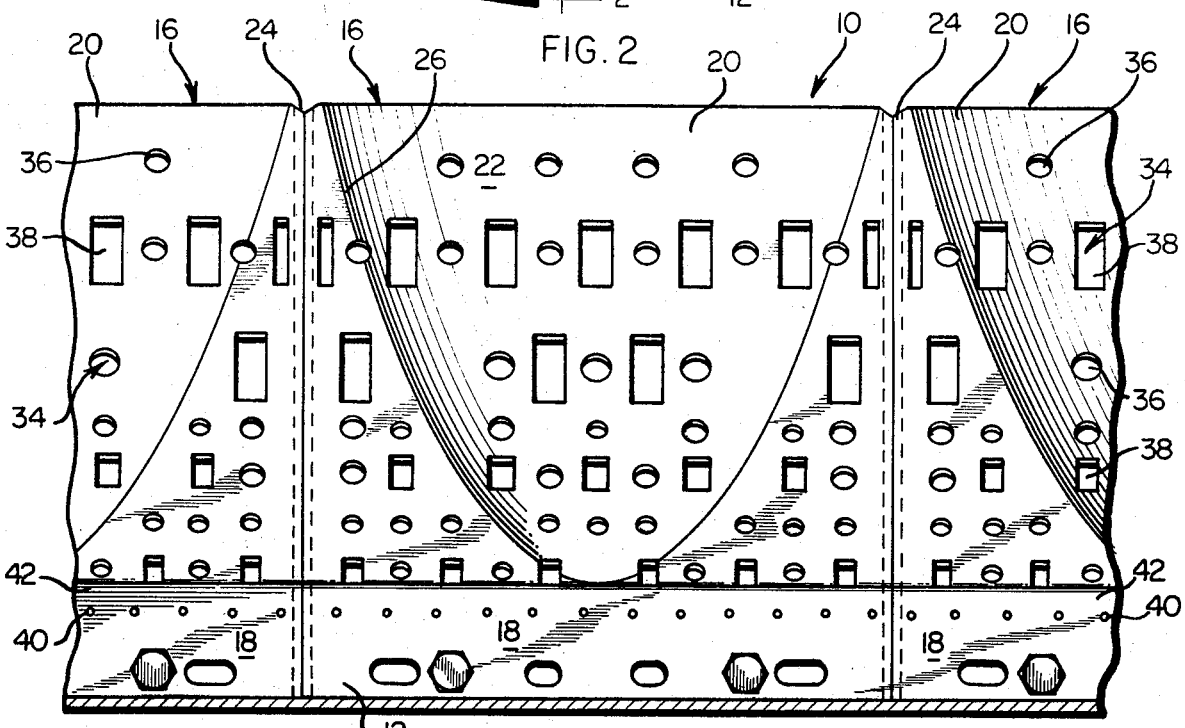
FIG. 2 is a longitudinal cross-sectional view taken along line 2—2 of FIG. 1, showing the generally parabolic shape of the bulge in the center of the mixing plate body, and further showing the type and number of aeration openings in the mixing plate body, which in preferred embodiments increase in area and/or number from the bottom to the top of said mixing plates.
Figure 3:
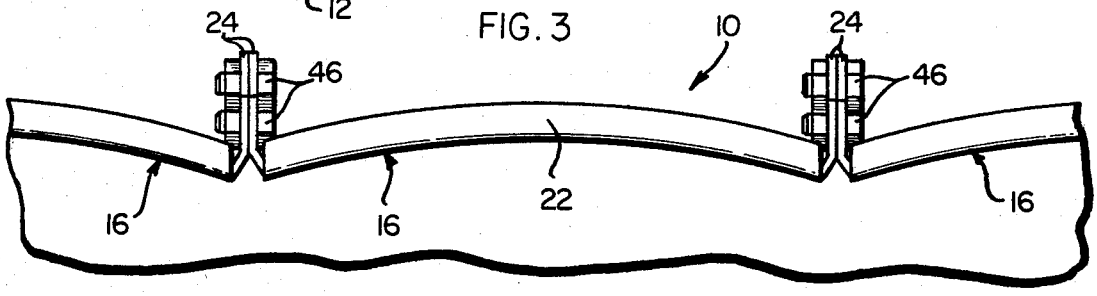
FIG. 3 is a cross-sectional view taken along line 3—3 of FIG. 1, showing a top view and looking down generally into the trough of the mixing plate, and further showing the protruding bulge shape of the mixing plate body, with several mixing plate bodies attached together, thereby to alleviate problems of hinging between such mixing plate bodies.

The mixing plate body 20 extends upwardly from lower flange 18 to form the sides of burner trough 14. Mixing plate body 20 has an outwardly protruding bulge 22 at the center portion thereof. As shown in FIGS. 2 and 3, side flanges 24, 24 are disposed on and extend from the sides of each mixing plate 16 for engagement with and securement in series to a corresponding side flange 24 of a further mixing plate to form the burner. Bulge 22 in mixing plate body 20 is generally parabolic in shape as viewed from trough 14 of the burner. As shown in FIG. 2, such smooth curve or parabola 26 extends from a point proximate to lower flange 12, and smooth curve or parabola 26 opens upwardly towards the top 28 of mixing plate 16.

Burner base 12 includes a plurality of apertures 30 therein for a emission of burner fuel into burner trough 14 for ignition.

Bulge 22 in the mixing plate body 20 is disposed in the center of mixing plate body 20. Such bulge 22 is greater in outward extension near top 28 of mixing plate body and lesser in outward extension near the bottom 32 thereof as indicated by dotted lines in FIG. 1. The preferred shape for such outward bulge 22 in horizontal section is a partial arc of a circle as shown in FIG. 3.

Moreover, the total area of the mixing plate apertures 34 increases from bottom 32 of mixing plate 16 to top 28 thereof.

As also shown in FIG. 2, such aeration openings 34 are disposed in horizontally extending rows, and may comprise circles 36 and/or slots 38. Where such mixing plate aeration openings 34 comprise slots 38, such slots 38 may be preferably greater in the vertical dimension than in horizontal dimension, as shown. As shown in FIG. 2, a plurality 40 of mixing plate apertures 34 of relatively small area are disposed near the top portion 42 of lower flange 18 to provide aeration at minimum firing rates.

As shown in FIG. 1, lower flange 18 and mixing plate body 20 are disposed with respect to each other at an angle which is less than approximately 180° and more than approximately 135°, with an optimum angle of disposition at approximately 155°, as shown.

Bolts 44 are provided for securing burner base 12 to lower flange 18 of mixing plates 16. Bolts 46 are likewise provided for securing side flanges 24, 24 of respective adjoining mixing plates 16, 16.

The invention set forth hereinabove is intended to encompass other specific embodiments without departing from the spirit or the essential characteristics of the present invention. The above embodiments are therefore to be considered in all respects as being illustrative and not restrictive in any manner of the scope of the present invention, which scope is supplemented by the dependent claims, and all changes which come within the meaning and range of equivalency of the claims are therefore intended to be embraced within the scope of the present invention.

What is claimed is:

1. An improved burner unit for disposition in longitudinally connected array to form a burner trough, such burner for use in relatively lower oxygen and/or lower pressure drop air streams, and having improved thermal expansion performance, said burner unit comprising:

a burner base disposed at the bottom of the burner trough;

a pair of mixing plates having aeration openings therein, said mixing plates disposed on opposite lateral sides of said burner base, said mixing plates having i. a lower flange disposed at the bottom of said mixing plate for attachment thereof to said burner base, ii. a mixing plate body extending upwardly from said lower flange to form the sides of such burner trough, said mixing plate sides comprising a bulge therein which protrudes outwardly with respect to the burner trough said bulge containing at least a portion of said aeration openings, and iii. side flanges disposed on and extending from the sides of said mixing plate for engagement with and securement in series to a corresponding side flange of a further mixing plate to form the burner.

2. The improved burner of claim 1 wherein said burner base includes a plurality of apertures therein for emission of burner fuel into the burner trough.

3. The improved burner unit of claim 1 wherein said bulge is a smooth curve in shape as viewed from such trough of such burner.

4. The improved burner unit of claim 1 wherein said bulge is generally parabolic in shape as viewed from such trough of such burner.

5. The improved burner unit of claim 4 wherein said parabola extends from a point in proximity to said lower flange and opens upwardly towards the top of said mixing plate.

6. The improved burner unit of claim 1 wherein said bulge is disposed in the center of the mixing plate body.

7. The improved burner unit of claim 1 wherein said bulge is greater in outward extension near the top of the outward bulge and lesser in outward extension near the bottom thereof.

8. The improved burner unit of claim 1 wherein a shape of said outward bulge in horizontal section is a partial arc of a circle.

9. The improved burner unit of claim 1 wherein the aeration openings of said mixing plate increase in area from the bottom to the top of said mixing plate.

10. The improved burner unit of claim 1 wherein the aeration openings of said mixing plate increase in number from the bottom to the top of said mixing plate.

11. The improved burner unit of claim 1 wherein the aeration openings of said mixing plate increase in area and in number from the bottom to the top of said mixing plate.

12. The improved burner unit of claim 1 wherein from the bottom of said mixing plate to the top thereof the total area of said mixing plate comprising said aeration openings increases.

13. The improved burner unit of claim 1 wherein said aeration openings of said mixing plate are disposed in longitudinally extending rows.

14. The improved burner unit of claim 1 wherein at least some of said aeration openings of said mixing plate comprise circles.

15. The improved burner unit of claim 1 wherein at least some of said aeration openings of said mixing plate comprise slots.

16. The improved burner unit of claim 15 wherein said slots are greater in the vertical dimension than in the horizontal dimension.

17. The improved burner unit of claim 1 further comprising on said mixing plate a plurality of relatively small aeration openings disposed near the top portion of said lower flange to provide aeration at minimal firing rates.

18. The improved burner unit of claim 1 wherein said lower flange and said mixing plate body are disposed at an angle to each other of at less than approximately 180° and more than approximately 135°.

19. The improved burner unit of claim 18 wherein said angle is approximately 155°.

* * * * *